US009117348B2

(12) United States Patent
Tang

(10) Patent No.: US 9,117,348 B2
(45) Date of Patent: Aug. 25, 2015

(54) WIRELESS GAS CONDITION MONITORING DEVICE

(71) Applicant: Ingersoll-Rand Company, Davidson, NC (US)

(72) Inventor: Chun Jian Tang, Annandale, NJ (US)

(73) Assignee: INGERSOLL-RAND COMPANY, Davidson, NC (US)

( * ) Notice: Subject to any disclaimer, the term of this patent is extended or adjusted under 35 U.S.C. 154(b) by 0 days.

(21) Appl. No.: 14/216,078

(22) Filed: Mar. 17, 2014

(65) Prior Publication Data

US 2014/0266711 A1 Sep. 18, 2014

Related U.S. Application Data

(60) Provisional application No. 61/799,870, filed on Mar. 15, 2013.

(51) Int. Cl.
*G08B 1/08* (2006.01)
*F17D 5/02* (2006.01)
(Continued)

(52) U.S. Cl.
CPC ..... *G08B 1/08* (2013.01); *F15B 19/005* (2013.01); *F17D 5/02* (2013.01); *F15B 20/005* (2013.01);
(Continued)

(58) Field of Classification Search
CPC ..... F15B 20/005; G08B 1/08
USPC ..... 340/539.22, 605, 584, 611, 626, 632; 348/81
See application file for complete search history.

(56) References Cited

U.S. PATENT DOCUMENTS 5,730,942 A 3/1998 Megerle
6,408,682 B2 6/2002 Greszler
(Continued)

FOREIGN PATENT DOCUMENTS

GB 2189887 11/1987

OTHER PUBLICATIONS

VP Instruments, VP FlowMate User Manual for VP FlowMate probe, and VP FlowMate in-line (with M12 8-pole connector), 40 pages, Copyright 2001-2011 Van Putten Instruments B.V., The Netherlands.
(Continued)

*Primary Examiner* — Toan N Pham
(74) *Attorney, Agent, or Firm* — Taft Stettinius & Hollister LLP

(57) ABSTRACT

An exemplary apparatus includes a sensor array configured to sense a gas stream temperature, pressure, and humidity. The sensor array includes a plurality of sensors, each configured to sense at least one of the gas stream conditions. The apparatus further includes an electronic control unit comprising a memory storage device, a condition evaluation module, a display module, and a wireless transmission module. The memory storage device stores a plurality of condition parameters, each condition parameter corresponding to one of the gas stream conditions. The condition evaluation module is configured to determine if one of the sensed conditions violates one of the corresponding parameters, and is further configured to output a warning command in response to the determining. The display module is configured to display information relating to at least one of a sensed condition and a condition parameter. The wireless transmission module is configured to wirelessly transmit data relating to at least one of the warning command and one of the sensed conditions.

24 Claims, 4 Drawing Sheets

(51) Int. Cl.
*F15B 19/00* (2006.01)
*F15B 20/00* (2006.01)

(52) U.S. Cl.
CPC . *F15B 2211/6306* (2013.01); *F15B 2211/6343* (2013.01); *F15B 2211/857* (2013.01); *F15B 2211/8636* (2013.01); *F15B 2211/87* (2013.01); *F15B 2211/8855* (2013.01)

(56) References Cited

U.S. PATENT DOCUMENTS

| | | | | |
|---|---|---|---|---|
| 7,285,156 | B2 | 10/2007 | Arno et al. | |
| 7,332,013 | B2 | 2/2008 | Arno et al. | |
| 7,509,864 | B2 | 3/2009 | Charpie | |
| 7,817,050 | B2 * | 10/2010 | Goodman et al. | 340/632 |
| 8,047,079 | B2 | 11/2011 | Bleys et al. | |
| 8,359,171 | B2 | 1/2013 | Bleys et al. | |
| 2003/0158698 | A1 | 8/2003 | Glazerbrook | |
| 2010/0082293 | A1 | 4/2010 | Mitchell et al. | |
| 2011/0248856 | A1 | 10/2011 | Obenchain | |

OTHER PUBLICATIONS

VP FlowScope dP, Brochure, Undated, 3 pages, Copyright 2012 VP Instruments.

VP FlowMate, Brochure, Undated, 3 pages, Copyright 2012 VP Instruments.

* cited by examiner

WIRELESS GAS CONDITION MONITORING DEVICE

CROSS REFERENCE TO RELATED APPLICATIONS

The present application claims the benefit of U.S. Provisional Patent Application Ser. No. 61/799,870 filed Mar. 15, 2013, the contents of which are incorporated herein by reference in their entirety.

BACKGROUND

The present invention generally relates to gas monitoring devices, and more particularly relates to a wireless gas condition monitoring device.

Gas monitoring devices offer a number of potential benefits for applications in which a gas is delivered from a source to a point of use. Gas monitoring devices provide particular benefits when the gas is a compressed gas, such as compressed air. In such systems, the compressor may begin to fail, or leaks may develop in the delivery system, resulting in unsatisfactory delivery of the compressed gas. Contaminants, such as a compressor-lubricating oil, may also become present in the compressed gas. Gas monitoring devices allow a user to monitor conditions of the gas, and to take appropriate steps to remedy any undesired conditions. Conventional designs often place sensors near a point of use, and transmit the data to a control system via cabling. These approaches suffer from a number of disadvantages and shortcomings, including the fact that in large delivery systems, thousands of feet of the cabling may be required. There is a need for the unique and inventive apparatuses, methods and systems disclosed herein.

SUMMARY

Unique wireless gas monitoring apparatuses, methods, and systems are disclosed. In an exemplary embodiment, the system includes a sensor array configured to sense parameters of a gas stream including temperature, pressure, and humidity. The sensor array includes a plurality of sensors, each configured to sense at least one of the gas stream conditions. The apparatus further includes an electronic control unit comprising a memory storage device, a condition evaluation module, a display module, and a wireless transmission module. The memory storage device stores a plurality of condition parameters, each condition parameter corresponding to one of the gas stream conditions. The condition evaluation module is configured to determine if one or more of the sensed conditions violates one of the corresponding parameters, and is further configured to output a warning command in response to the determination. The display module is configured to display information relating to at least one of a sensed condition value and a condition parameter. The wireless transmission module is configured to wirelessly transmit data relating to at least one of the warning command and one of the sensed condition values.

One exemplary embodiment is an apparatus comprising a sensor array configured to sense a plurality of gas stream conditions comprising a temperature, a pressure, and a humidity, the sensor array comprising a plurality of sensors, each configured to sense a value of at least one of the gas stream conditions, and an electronic control unit comprising a memory storage device configured to store a plurality of condition parameters, each condition parameter corresponding to one of the gas stream conditions, a sensor module configured to receive the sensed condition values from the sensor array, a condition evaluation module configured to evaluate one of the sensed condition values relative to one of the corresponding parameters, and to output a warning command in response to the evaluation, a display module configured to display at least one of one or more of the sensed condition values and one or more of the condition parameters, and a wireless transmission module configured to wirelessly transmit data relating to at least one of the warning command and the sensed condition values.

In some forms a single sensor of the sensor array is configured to sense the gas stream humidity and the gas stream temperature. In some forms at least one of the plurality of sensors is a micro-electromechanical sensor. In some forms the sensor array is further configured to sense a gas stream contaminant level. Some forms further comprises a warning indicator configured to provide a visual or audible warning in response to the warning command. In some forms the apparatus is configured to receive power from a battery. In some forms the display module comprises a light-emitting diode display. Some forms further comprise a user interface module configured to change the information displayed by the display module. In some forms the user interface module is further configured to adjust one or more of the condition parameters in response to a user command. Some forms further comprise a tube defining a flowpath, and having at least one hole through which at least one of the plurality of sensors extends into the flowpath.

One exemplary embodiment is a system for monitoring a compressed gas stream. The system comprises a monitoring device comprising a plurality of sensors, each configured to sense a value of a condition of the compressed gas stream, and a first wireless communication device configured to wirelessly transmit data relating to the sensed condition values; a receiving device comprising a second wireless communication device configured to receive the data transmitted by the first wireless communication device; a first user input configured to provide a first user command and a second user command; a first memory storage device configured to store a first range for each of the conditions, and configured to modify one of the first ranges in response to the first user command; a first display device configured to receive and display one or more sensed condition values, and to change the displayed condition value in response to the second user command; a first criteria evaluation module configured to receive the sensed condition values, to compare each of the sensed condition values to the first range of the condition, and to provide a first warning signal in response to the comparing; and a first warning indicator configured to provide a visual or audible warning in response to the warning signal. Each of the first user input, the first memory storage device, the first criteria evaluation module, and the first display device is included in one of the monitoring device and the receiving device.

In some forms the monitoring device includes the first memory storage device, the first criteria evaluation module, the first warning indicator, and the first display device, each of which is in communication with the first wireless communication device; the receiving device includes the first user input in communication with the second wireless communication device; the second wireless communication device is further configured to wirelessly transmit the first and second user commands; and the first wireless communication device is further configured to receive the first and second user commands transmitted by the second wireless communication device. In some forms the receiving device is further in communication with a data network configured to provide remote access to the data received by the second wireless communication device. In some forms each of the first user input, the first memory storage device, the first criteria evaluation module, the first warning indicator, and the first display device is included in the monitoring device; and the receiving device further comprising a second memory storage device configured to store the data received by the second wireless communication device from the first wireless communication device. In some forms, the receiving device further comprising a data analysis module configured to determine a trend of one of the sensed conditions based at least in part on the data stored in the second memory storage device. In some forms the first memory storage device is further configured to store a second range of a selected condition, the second range being different than the first range of the selected condition, and wherein the first criteria evaluation module is further configured to compare sensed value of the selected condition to the second range, and to provide a second warning signal in response to the comparing. Some forms further comprise a plurality of the monitoring devices, each in wireless communication with at least one of the receiving device and another of the plurality of monitoring devices. In some forms the monitoring device is operationally coupled to a compressed gas line near a point of use of the compressed gas. Some forms further comprise a pressure sensor configured to sense a pressure of the compressed gas stream at a location upstream of the monitoring device, and in communication with the receiving device.

One exemplary embodiment is a method, comprising sensing values of a plurality of conditions of a compressed gas stream near a point of use of the compressed gas, the plurality of conditions comprising a pressure, a temperature, and a humidity; wirelessly transmitting the sensed condition values to a wireless receiving device; displaying the sensed condition values received by the wireless receiving device; comparing the sensed condition values received by the wireless receiving device to a set of predetermined parameters; and alerting a user if one of the conditions violates one of the parameters. In some forms the comparing comprises comparing a selected sensed condition value received by the wireless receiving device to a first condition parameter, and alerting the user with a first alert in response to the sensed condition value violating the first condition parameter, and comparing the selected sensed condition value to a second condition parameter, and alerting the user with a second alert in response to the sensed condition value violating the second condition parameter. In some forms the first condition parameter corresponds to an optimal range of the condition, and wherein the second condition parameter corresponds to an acceptable range of the condition. Some forms further comprise altering at least one condition parameter, and comparing the sensed condition value to the altered condition parameter. Some forms further comprise storing the sensed condition values received by the wireless receiving device, and determining a trend of one or more of the sensed condition values based on the stored values.

One exemplary embodiment is a system, comprising a source of compressed air; a compressed air distribution network configured to convey the compressed air to a plurality of remote points; a plurality of sensors, each configured to determine parameters of the compressed air at a location proximate to one of the remote points, and to wirelessly transmit information relating to the parameters; and a wireless receiving device configured to receive the transmitted information.

Other aspects of the present invention will become apparent by consideration of the detailed description and accompanying drawings.

DESCRIPTION OF THE ILLUSTRATED EMBODIMENTS

Figure 1:
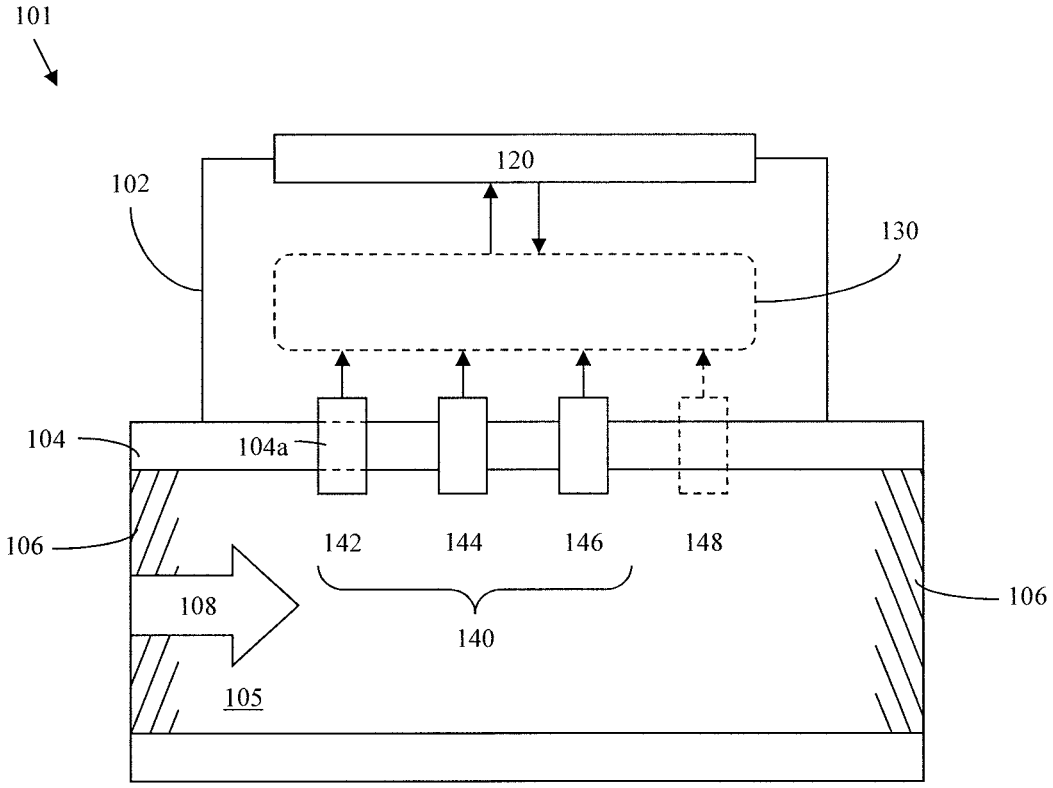
FIG. 1 is a schematic cut-away illustration of an exemplary gas monitoring device.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
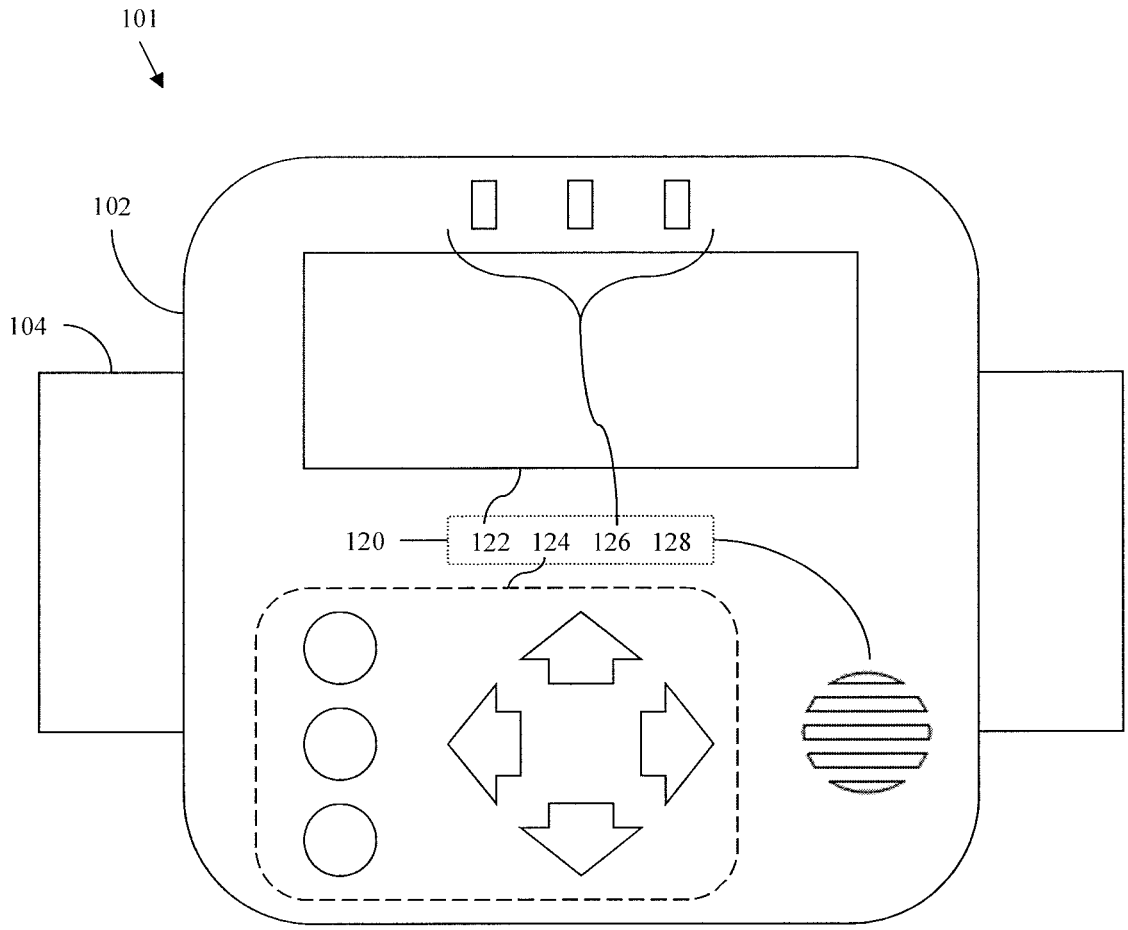
FIG. 2 is a schematic top view of the device of FIG. 1.

With reference to FIGS. 1 and 2, an exemplary monitoring device 101 is illustrated. Monitoring device 101 comprises a housing 102, a tube 104, a user interface 120, an electronic control unit (ECU) 130, and a sensor array 140. In the illustrated embodiment, monitoring device 101 is configured as an in-line gas monitoring device. That is, tube 104 is engageable with a compressed gas line 403 (FIG. 4) such that a compressed gas 108 flows through tube 104. It is also contemplated that monitoring device 101 may be configured as a probe-type sensor, in which case a hole is formed in compressed gas line 403, and sensor array 140 is disposed in the hole.

Housing 102 is configured to house user interface 120 and ECU 130. Housing 102 is further configured to couple with tube 104 to enclose ECU 130. Housing 102 may comprise a plurality of pieces configured to matingly engage with one another. One or more of the plurality of pieces may be formed integrally with tube 104.

Tube 104 is a hollow tube defining a flow path 105 through which gas 108 flows. Tube 104 may further comprise a plurality of threads 106 configured to engage a mating set of threads, for example of compressed gas line 403. In the illustrated embodiment, threads 106 are formed in opposite directions on the interior of tube 104, such that tube 104 may serve as a turnbuckle to couple two portions of compressed gas line 403. It is also contemplated that tube 104 may be configured with threads of the same direction, exterior threading, or threading on only one end. Tube 104 could alternatively be formed without threads 106. In such a case, sealing clamps (not shown) may be used to connect tube 104 to a compressed gas line, such as line 403 illustrated and described below in connection with FIG. 4.

User interface 120 is in communication with ECU 130, and comprises a display 122, a user input 124, warning lights 126, and a speaker 128. Display 122 may be, for example, a liquid crystal display (LCD) or a light emitting diode (LED) display. In the illustrated embodiment, user input 124 is a keypad, though other user inputs, such as touch screens, dials, sliders, and knobs are contemplated. Further, user input 124 could be formed integrally with display 122, for example as a touch-screen. Warning lights 126 may be, for example, colored LEDs. In certain embodiments, one or more of the warning lights 126 and/or speaker 128 may be omitted.

ECU 130 is a control device comprising a plurality of modules (described below with respect to FIG. 3), and is in communication with user interface 120. In the illustrated embodiment, ECU 130 is also in communication with sensor array 140. A plurality of connection ports are configured to engage sensors 142, 144, and 146, though more or fewer sensors may be used based on design requirements. ECU 130 may further comprise additional connection ports, by which additional sensors 148 may be easily added to the system at a later time.

Figure 4:
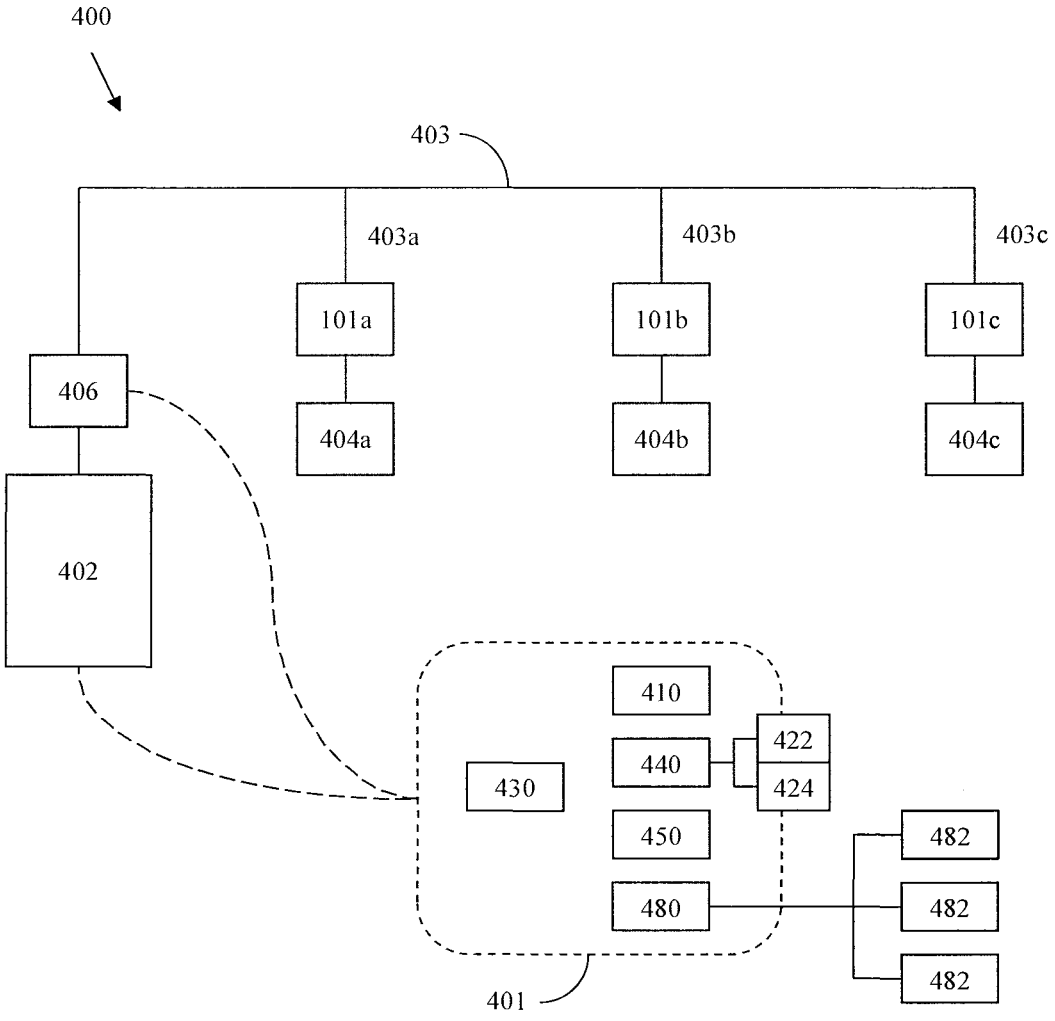
FIG. 4 is a schematic illustration of a compressed gas delivery and monitoring system.

Sensor array 140 is configured to sense a plurality of conditions of gas 108 in flowpath 105, and is in communication with ECU 130. Sensor array 140 comprises a plurality of sensors 142, 144, and 146, each of which is configured to sense at least one condition of the gas 108. In the illustrated embodiment, sensor array 140 comprises a pressure sensor 142, a contaminant sensor 144, and a combined temperature and relative humidity sensor 146. Pressure sensor 142 may be configured to sense a gage pressure of gas 108 or a differential pressure of gas 108. Contaminant sensor 144 may be configured to sense oil content of gas 108, for example an oil used to lubricate compressor 402 (FIG. 4). Contaminant sensor 144 may additionally or alternatively be configured to sense a concentration of other contaminants, such as particulate matter or a chemical compound.

Sensor array 140 may include more, fewer, or alternative sensors. For example, in addition to or alternatively to pressure sensor 142, sensor array 140 may include a hot wire sensor or vortex shedding flow meter to sense the flow rate of gas 108. Each of sensors 142, 144, and 146 is disposed in a hole 104*a* through the wall of tube 104. In the illustrated embodiment, a separate hole 104*a* is provided for each of sensors 142, 144, and 146. It is also contemplated that sensors 142, 144, and 146 may be disposed in a single hole 104*a*. Sensors 142, 144, and 146 may protrude into flowpath 105, or may be flush or recessed with respect to the inner surface of tube 104. A sealant (not shown) may cooperate with the sensors and tube 104 to prevent leakage of gas 108.

In certain embodiments, at least one of sensors 142, 144, and 146 is a micro-electromechanical systems (MEMS) sensor. By way of non-limiting example, pressure sensor 142 may be an NBP pressure sensor manufactured by Honeywell Sensing and Control of Golden Valley, Minn., or an MPX differential pressure sensor manufactured by Freescale Semiconductor, Inc., based in Austin, Tex.; sensor 146 may be a Si7005 humidity and temperature sensor from Silicon Laboratories, Inc., also based in Austin, Tex.

Figure 3:
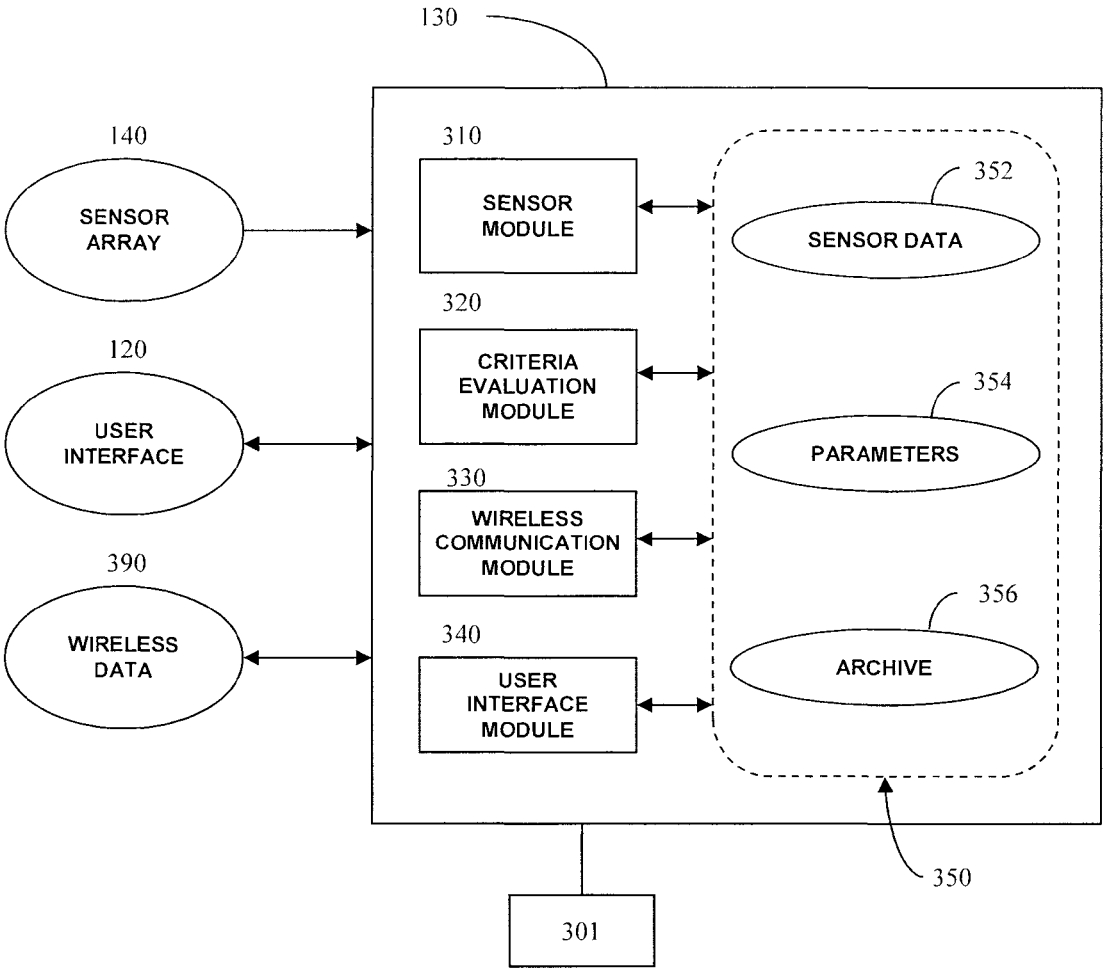
FIG. 3 is a schematic illustration of one embodiment the electronic control unit of the device of FIG. 1.

With respect to FIG. 3, an illustrative embodiment of ECU 130 is shown. ECU 130 comprises a sensor module 310, a criteria evaluation module 320, a wireless communication module 330, a user interface module 340, and a data storage module 350. ECU 130 is connected to a power supply 301, which may be a power grid, a battery, or a power grid with battery backup.

Sensor module 310 receives information from sensor array 140, and may interpret the information according to data from data storage module 350. For example, sensor module 130 may convert analogue sensed condition values from sensor array 140 to digital sensed condition values according to sensor data 352 stored on data storage module 350. Sensor module 310 may calculate other conditions of gas 108 using the sensed temperature values. For example, sensor module 310 may calculate a dew point of gas 108 based on sensed condition values. If sensor array 140 includes only one of a mass flow sensor and volumetric flow sensor, sensor module 310 may calculate the other of the mass flow and the volumetric flow of gas 108 based using the sensed flow value and the sensed temperature value in a manner known to those having skill in the art.

Criteria evaluation module 320 evaluates the sensed condition values, and determines an output command. In one aspect, criteria evaluation module 320 evaluates sensor information received by the sensor module 310. The criteria evaluation module 320 may compare the sensor information to parameters 354 stored on data storage module 350. In an exemplary embodiment, the criteria evaluation module 320 compares a received condition value to a range of the condition, and outputs a warning signal in response to the condition value being outside the range. The warning signal may activate one or more of warning lights 126, may produce an audible alert with speaker 128, and may command wireless communication module 330 to transmit a wireless warning signal. The warning signal may be a generic warning signal, indicating that one of the sensed condition values violates a parameter, or may be a specific warning signal, indicating which sensed condition violates a parameter.

In certain embodiments, criteria evaluation module 320 compares a sensed condition value to a plurality of acceptable ranges. For example, if criteria evaluation module 320 determines that the gas pressure has fallen below an optimal pressure level, criteria evaluation module 320 may provide a non-critical warning command to alert a user that the pressure is outside of an optimal range. If criteria evaluation module 320 determines that the gas pressure has fallen below a minimum pressure level, criteria evaluation module 320 may provide a critical warning command to alert a user that the pressure is outside of an acceptable range. The different warning commands may, for example, activate different colors of warning lights 126, produce different audible alerts with speaker 128, and/or cause wireless communication module 330 to transmit different wireless warning signals.

Criteria evaluation module 320 may compare only current sensed temperature values to the condition parameters, or criteria evaluation module 320 may perform additional analysis. For example, data storage module 350 may include an archive 356 of previous sensed condition values, and criteria evaluation module 320 may perform proportional-integral-derivative (PID) analysis using the archived sensed condition values.

Wireless communication module 330 is configured to wirelessly communicate with another device, for example a receiver 401 (FIG. 4), or a second monitoring device 101. Wireless communication module 330 may transmit data 390 by any wireless communication method known in the art, such as, for example, radio, microwave, infrared, ultrasonic, Wi-Fi, or electromagnetic induction. Wireless communication module 330 is configured to transmit data relating to at least one of the warning signal and a sensed condition value. Wireless communication module 330 may transmit data continuously, or the data may be transmitted intermittently. For example, sensed condition values may be stored on data storage module 350, and transmitted by wireless communication module 330 in discrete bursts. As another example, wireless communication module 330 may be configured to transmit data only in response to a warning signal.

Wireless communication module 330 may further be configured to receive data from another wireless communication device, such as that of receiving device 401. In such a case, one or more of the functions of criteria evaluation module 320, user interface module 340, and data storage module 350 may be performed by a corresponding module of receiving device 401. Wireless communication module 330 may further be configured to communicate with a wireless communication module 330 of another monitoring device 101. For example, in a system such as that shown in FIG. 4, each monitoring device 101*a*, 101*b*, and 101*c* may be in direct communication with receiving device 401, or one or more monitoring device 101 may receive data from one or more other monitoring devices 101 and relay the data to receiving device 401.

User interface module 340 is configured to communicate with user interface 120 and/or a user interface 420 of receiving device 401, as described below. User interface module 340 provides information, such as a sensed condition value or a current parameter, which is displayed on display 122. User interface module 340 is further configured to receive user commands from user input 124. User interface module 340 may be configured to change the information displayed on display 122 in response to a first user command. User interface module 340 may further be configured to alter a parameter 354 stored on data storage module 350 in response to a second user command.

Data storage module 350 is a non-transitory computer readable medium configured to store data for use by other modules of ECU 130. Data storage module 350 may store, for example, sensor data 352 such as sensor calibration data, parameters 354 such as trip values for pressure, temperature, and humidity, and an archive 356 of data received from sensor array 140.

It shall be appreciated that the controls, control routines, and control modules described herein may be implemented using hardware, software, firmware and various combinations thereof and may utilize executable instructions stored in a non-transitory computer readable medium or multiple non-transitory computer readable media. It shall further be understood that ECU 130 may be provided in various forms and may include a number of hardware and software modules and components such as those disclosed herein.

With additional reference to FIG. 4, an exemplary compressed gas distribution system 400 comprises a compressor 402, a compressed gas line 403, points of use 404, monitoring devices 101, and a receiving device 401. In the illustrated embodiment, there are three each of monitoring devices 101 and points of use 404. It is also contemplated that more or fewer monitoring devices 101 and points of use 404 may be included, for example depending on compressed gas delivery requirements and the capacity of compressor 402.

Compressor 402 is configured to compress a gas such as, for example, air, and discharge the compressed gas to compressed gas line 403, where it is divided into branches 403*a*, 403*b*, and 403*c*, and distributed to the corresponding points of use 404*a*, 404*b*, and 404*c*. Points of use 404 may be any location at which compressed gas is used, and each point of use 404 may utilize the compressed gas for the same or different purpose. By way of non-limiting example, point of use 404 may be a pneumatic device, such as a rotary tool, a reciprocating tool, an airbrush, jackhammer, or sandblaster.

Monitoring devices 101 are configured to sense conditions of the gas in compressed gas line 403. In the illustrated embodiment, tube 104 is coupled to compressed gas line 403 such that the compressed gas flows to point of use 404 via tube 104. It is also contemplated monitoring device 101 may be a probe-type sensor, in which case a hole is formed in compressed gas line 403, and sensor array 140 is in communication with the compressed gas in compressed gas line 403. In the illustrated embodiment, each monitoring device 101 is located near a point of use 404—that is, each monitoring device 101 is much closer to the corresponding point of use 404 than to compressor 402. It is also contemplated that monitoring devices 101 may additionally or in the alternative be positioned at other locations, such as the main compressed gas line 403.

In the illustrated embodiment, receiving device 401 comprises a data interpretation module 410, a wireless communication module 430, a user interface module 440, and a memory storage device 450. Receiving device 401 may further comprise a data network connection 480 in communication with one or more user terminals 482. User terminals 482 may perform one or more functions of receiving device 401. Network connection 480 may connect receiving device 401 to the internet, such that user terminals 482 may be any device having an internet connection, such as a computer, mobile phone, or personal digital assistant.

Wireless communication module 430 is configured to receive data transmitted by wireless communication module 130. Wireless communication module 430 may further be configured to transmit data to wireless communication module 130, such that one or more of the functions of user interface 120, criteria evaluation module 320, user interface module 340, and data storage module 350 may be performed by receiving device 401. For example, user interface module 440 may be configured to display the sensed condition values on display 422 in addition to or instead of display 122.

System 400 may further comprise an additional sensor 406 at or near compressor 402. In such a case, sensor 406 is configured to sense a condition of the compressed gas stream at or near compressor 402 and to communicate the sensed condition value to receiver 401. Receiver 401 may compare the condition values sensed by sensor 406 to a condition value sensed by one or more of monitoring devices 101*a*, 101*b*, and 101*c*. For example, sensor 406 may be a pressure sensor, and receiving device 401 may compare pressure sensed by sensor 406 to a pressure sensed by monitoring device 101*a* to determine if there is a leak in compressed gas line 403. Sensor 406 may alternatively be a monitoring device 101.

In certain embodiments of system 400, receiving device 401 is in communication with compressor 402, such that compressor 402 can be controlled by or through receiving device 401. Receiving device 401 may similarly be configured to control additional components of system 400, such as points of use 404 and regulator valves (not shown).

It shall be understood that the exemplary embodiments summarized and described in detail above and illustrated in the figures are illustrative and not limiting or restrictive. Only the presently preferred embodiments have been shown and described and all changes and modifications that come within the scope of the invention are to be protected. It shall be appreciated that the embodiments and forms described below may be combined in certain instances and may be exclusive of one another in other instances. Likewise, it shall be appreciated that the embodiments and forms described below may or may not be combined with other aspects and features disclosed elsewhere herein. It should be understood that various features and aspects of the embodiments described above may not be necessary and embodiments lacking the same are also protected. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Various features and advantages of the present invention are set forth in the following claims. Additionally, changes and modifications to the described embodiments described herein will be apparent to those skilled in the art, and such changes and modifications can be made without departing from the spirit and scope of the present invention and without diminishing its intended advantages. While the present invention has been illustrated and described in detail in the drawings and foregoing description, the same is to be considered illustrative and not restrictive in character, it being understood that only selected embodiments have been shown and described and that all changes, equivalents, and modifications that come within the scope of the inventions described herein or defined by the following claims are desired to be protected.

What is claimed is:

1. An apparatus comprising:

a sensor array configured to sense a plurality of gas stream conditions comprising a temperature, a pressure, and a humidity, the sensor array comprising a plurality of sensors, each configured to sense a value of at least one of the gas stream conditions; and an electronic control unit comprising:

a memory storage device configured to store a plurality of condition parameters, each condition parameter corresponding to one of the gas stream conditions, a sensor module configured to receive the sensed condition values from the sensor array, a condition evaluation module configured to evaluate one of the sensed condition values relative to one of the corresponding parameters, and to output a warning command in response to the evaluation, a display module configured to display at least one of one or more of the sensed condition values and one or more of the condition parameters, and a wireless transmission module configured to wirelessly transmit data relating to at least one of the warning command and the sensed condition values.

2. The apparatus of claim 1, wherein a single sensor of the sensor array is configured to sense the gas stream humidity and the gas stream temperature.

3. The apparatus of claim 1, wherein at least one of the plurality of sensors is a micro-electromechanical sensor.

4. The apparatus of claim 1, wherein the sensor array is further configured to sense a gas stream contaminant level.

5. The apparatus of claim 1, further comprising a warning indicator configured to provide a visual or audible warning in response to the warning command.

6. The apparatus of claim 1, wherein the apparatus is configured to receive power from a battery.

7. The apparatus of claim 6, wherein the display module comprises a light-emitting diode display.

8. The apparatus of claim 1, further comprising a user interface module configured to change the information displayed by the display module.

9. The apparatus of claim 8, wherein the user interface module is further configured to adjust one or more of the condition parameters in response to a user command.

10. The apparatus of claim 1, further comprising a tube defining a flowpath, and having at least one hole through which at least one of the plurality of sensors extends into the flowpath.

11. A system for monitoring a compressed gas stream, the system comprising:

a monitoring device comprising a plurality of sensors, each configured to sense a value of a condition of the compressed gas stream, and a first wireless communication device configured to wirelessly transmit data relating to the sensed condition values;

a receiving device comprising a second wireless communication device configured to receive the data transmitted by the first wireless communication device;

a first user input configured to provide a first user command and a second user command;

a first memory storage device configured to store a first range for each of the conditions, and configured to modify one of the first ranges in response to the first user command;

a first display device configured to receive and display one or more sensed condition values, and to change the displayed condition value in response to the second user command;

a first criteria evaluation module configured to receive the sensed condition values, to compare each of the sensed condition values to the first range of the condition, and to provide a first warning signal in response to the comparing; and a first warning indicator configured to provide a visual or audible warning in response to the warning signal;

wherein each of the first user input, the first memory storage device, the first criteria evaluation module, and the first display device is included in one of the monitoring device and the receiving device.

12. The system of claim 11, wherein the monitoring device includes the first memory storage device, the first criteria evaluation module, the first warning indicator, and the first display device, each of which is in communication with the first wireless communication device;

wherein the receiving device includes the first user input in communication with the second wireless communication device;

wherein the second wireless communication device is further configured to wirelessly transmit the first and second user commands; and wherein the first wireless communication device is further configured to receive the first and second user commands transmitted by the second wireless communication device.

13. The system of claim 12, wherein the receiving device is further in communication with a data network configured to provide remote access to the data received by the second wireless communication device.

14. The system of claim 11, wherein each of the first user input, the first memory storage device, the first criteria evaluation module, the first warning indicator, and the first display device is included in the monitoring device; and the receiving device further comprising a second memory storage device configured to store the data received by the second wireless communication device from the first wireless communication device.

15. The system of claim 14, the receiving device further comprising a data analysis module configured to determine a trend of one of the sensed conditions based at least in part on the data stored in the second memory storage device.

16. The system of claim 11, wherein the first memory storage device is further configured to store a second range of a selected condition, the second range being different than the first range of the selected condition, and wherein the first criteria evaluation module is further configured to compare sensed value of the selected condition to the second range, and to provide a second warning signal in response to the comparing.

17. The system of claim 11, further comprising a plurality of the monitoring devices, each in wireless communication with at least one of the receiving device and another of the plurality of monitoring devices.

18. The system of claim 11, wherein the monitoring device is operationally coupled to a compressed gas line near a point of use of the compressed gas.

19. The system of claim 18, further comprising a pressure sensor configured to sense a pressure of the compressed gas stream at a location upstream of the monitoring device, and in communication with the receiving device.

20. A method, comprising:

sensing values of a plurality of conditions of a compressed gas stream near a point of use of the compressed gas, the plurality of conditions comprising a pressure, a temperature, and a humidity;

wirelessly transmitting the sensed condition values to a wireless receiving device;

displaying the sensed condition values received by the wireless receiving device;

comparing the sensed condition values received by the wireless receiving device to a set of predetermined parameters; and alerting a user if one of the conditions violates one of the parameters.

21. The method of claim 20, wherein the comparing comprises:

comparing a selected sensed condition value received by the wireless receiving device to a first condition parameter, and alerting the user with a first alert in response to the sensed condition value violating the first condition parameter; and comparing the selected sensed condition value to a second condition parameter, and alerting the user with a second alert in response to the sensed condition value violating the second condition parameter.

22. The method of claim 21, wherein the first condition parameter corresponds to an optimal range of the condition, and wherein the second condition parameter corresponds to an acceptable range of the condition.

23. The method of claim 21, further comprising altering at least one condition parameter, and comparing the sensed condition value to the altered condition parameter.

24. The method of claim 20, further comprising storing the sensed condition values received by the wireless receiving device, and determining a trend of one or more of the sensed condition values based on the stored values.

* * * * *